US010704273B1

(12) United States Patent
Lilley

(10) Patent No.: US 10,704,273 B1
(45) Date of Patent: Jul. 7, 2020

(54) TROWEL

(71) Applicant: David Lilley, Evertt, WA (US)

(72) Inventor: David Lilley, Evertt, WA (US)

( * ) Notice: Subject to any disclaimer, the term of this patent is extended or adjusted under 35 U.S.C. 154(b) by 6 days.

(21) Appl. No.: 16/251,722

(22) Filed: Jan. 18, 2019

(51) Int. Cl.
*E04F 21/16* (2006.01)

(52) U.S. Cl.
CPC ..... *E04F 21/162* (2013.01); *E04F 21/16* (2013.01); *E04F 21/161* (2013.01); *E04F 21/163* (2013.01)

(58) Field of Classification Search
CPC ..... E04F 21/161; E04F 21/16
See application file for complete search history.

(56) References Cited

U.S. PATENT DOCUMENTS 6,178,586 B1 * 1/2001 Jafarmadar ..... B25F 1/00 15/235.4
7,343,639 B2 * 3/2008 Dranginis ..... A47L 13/02 15/236.01
7,694,381 B2 * 4/2010 Heaslet ..... A63C 11/08 15/236.08
D625,976 S * 10/2010 Whiteside ..... D8/45
9,051,744 B1 * 6/2015 Murray ..... B26B 9/00
D799,301 S * 10/2017 Cetera ..... D8/105
2004/0159334 A1 * 8/2004 Katsin ..... A47L 13/08 134/8
2006/0162111 A1 * 7/2006 Miller ..... E04F 21/162 15/235.6
2007/0061988 A1 * 3/2007 Hurley ..... B25F 1/00 15/235.6

* cited by examiner

*Primary Examiner* — Michael D Jennings
(74) *Attorney, Agent, or Firm* — Puget Patent; Michael Gibbons

(57) ABSTRACT

The present invention is a trowel having a blade with a rounded side edge, a straight side edge, and a notched edge between the rounded side edge and the straight side edge. The trowel may include a handle disposed opposite the notched edge and substantially parallel to the straight side edge, aligned with the plane of the blade. The blade may be made of a thin or flexible material, allowing the blade to be slightly deformed during use to create a consistent layer of adhesive. The rounded edge may be of a relatively smaller radius, allowing for a wider, shorter blade. In other embodiments, the rounded edge may be of a relatively bigger radius, allowing for a narrower, taller blade. The notched edge may be square notches, v-notches, u-notches, or other notch shapes according to user preference.

7 Claims, 4 Drawing Sheets

TROWEL

FIELD OF THE INVENTION

This invention relates generally to construction tools, and more specifically to tools for spreading and scraping adhesives.

BACKGROUND OF THE INVENTION

Standard trowels used for spreading adhesives, such as mastics and mortars, generally have a rectangular shape, a handle on a back side, where the front side is used for spreading the adhesive. Typically, they are made of a fairly rigid metal, and have a straight edge side opposite a notched side. These trowels are usually left- or right-handed, requiring a job site to keep the proper type of trowel on site for both left- and right-handed users, and require a user to handle the trowel at an uncomfortable angle in order to scrape the adhesive from a bucket. Finally, standard adhesive trowels tend to be difficult to clean due to the location of the handle and the resulting inability to simply scrape the adhesive from both surfaces of the trowel, often requiring a second tool. These are some of the issues which the present invention aims to improve.

SUMMARY OF THE INVENTION

This invention relates generally to construction tools, and more specifically to tools for spreading and scraping adhesives.

The invention consists essentially of a handle and a blade. In some embodiments, the blade may include a rounded or curved side edge, a straight side edge, and a notched bottom edge between the curved side edge and the straight side edge. In preferred embodiments, the handle may be disposed substantially parallel to the side edges and opposite the notched edge. The blade may be comprised of a rigid material, and in preferred embodiments it may be comprised of a slightly flexible material.

The curve of the rounded side edge may have radii of varying degrees, as suited to a particular use or user, and smaller radius blades may result in slightly wider or shorter blades than bigger radius blades. However, size of blade may be independent of the radius of the curved side, as suited to a particular need. The notched edge may be a square notch, a v-notch, a u-notch, or virtually any style of notch suited to a particular use or user.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to construction tools, and more specifically to tools for spreading and scraping adhesives.

Specific details of certain embodiments of the invention are set forth in the following description and in FIGS. 1-4 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
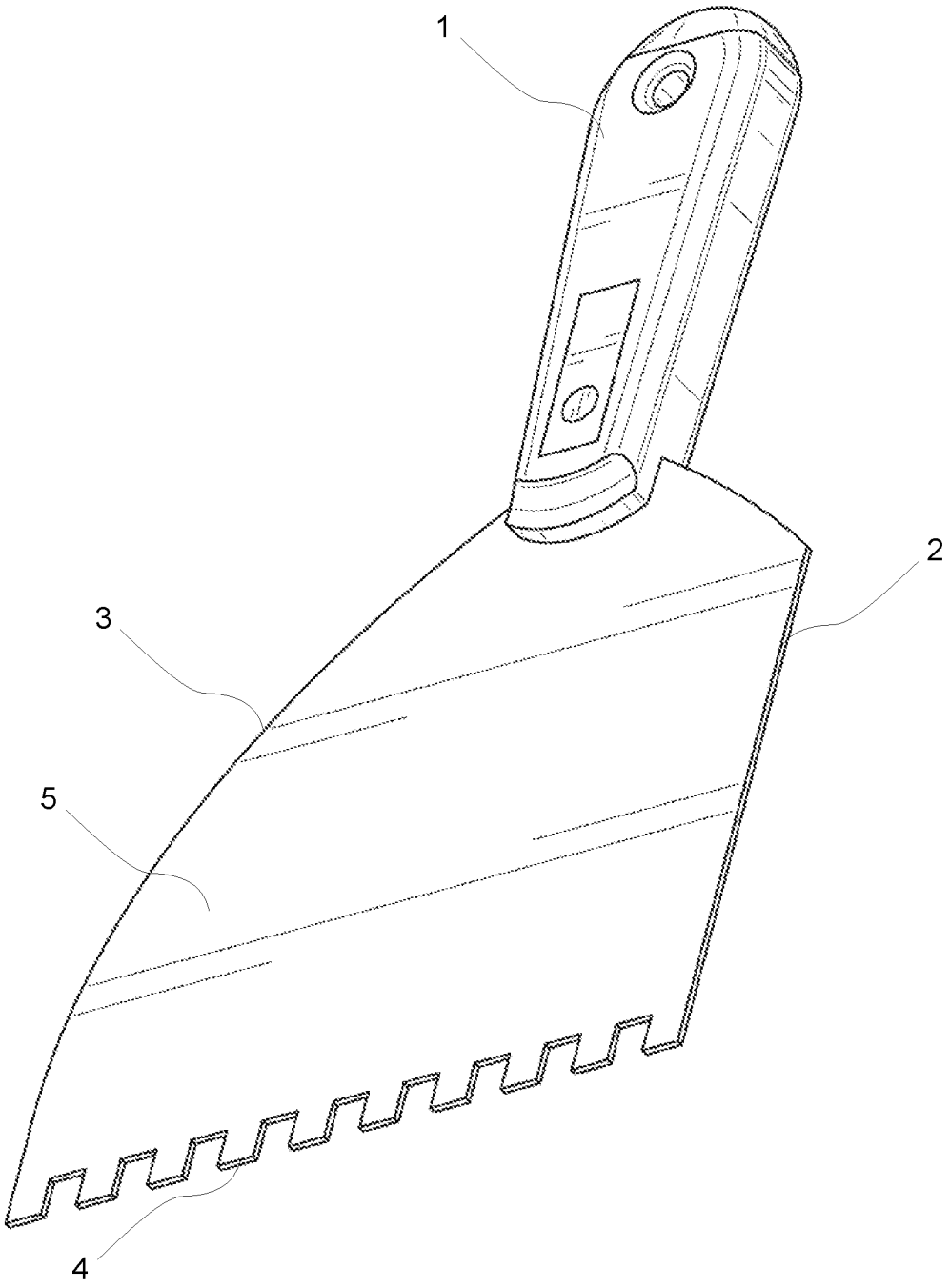
FIG. 1 is an isometric view of one embodiment of the trowel.

FIG. 1 is an isometric view of the trowel having a handle 1 coupled with the top of blade 5. The handle 1 may have a full or partial tang or shank, and preferred embodiments will have a full tang in order to provide the best control of the trowel. The handle 1 may be substantially parallel to straight side edge 2. This offers a particular advantage over many existing trowels, because it allows both left-handed and right-handed users to use the trowel for loading the trowel and spreading the adhesive, and because it allows for easy cleaning of the trowel by allowing a user to scrape both sides of the blade 5 against, for example, the rim of a bucket, rather than having to use another tool. In combination with the handle 1, straight side edge 2 also allows a user to properly hold the trowel in the bucket to scrape adhesive off the side of the bucket, rather than requiring a user to hold the trowel backward to load it as with a standard trowel.

Figure 2:
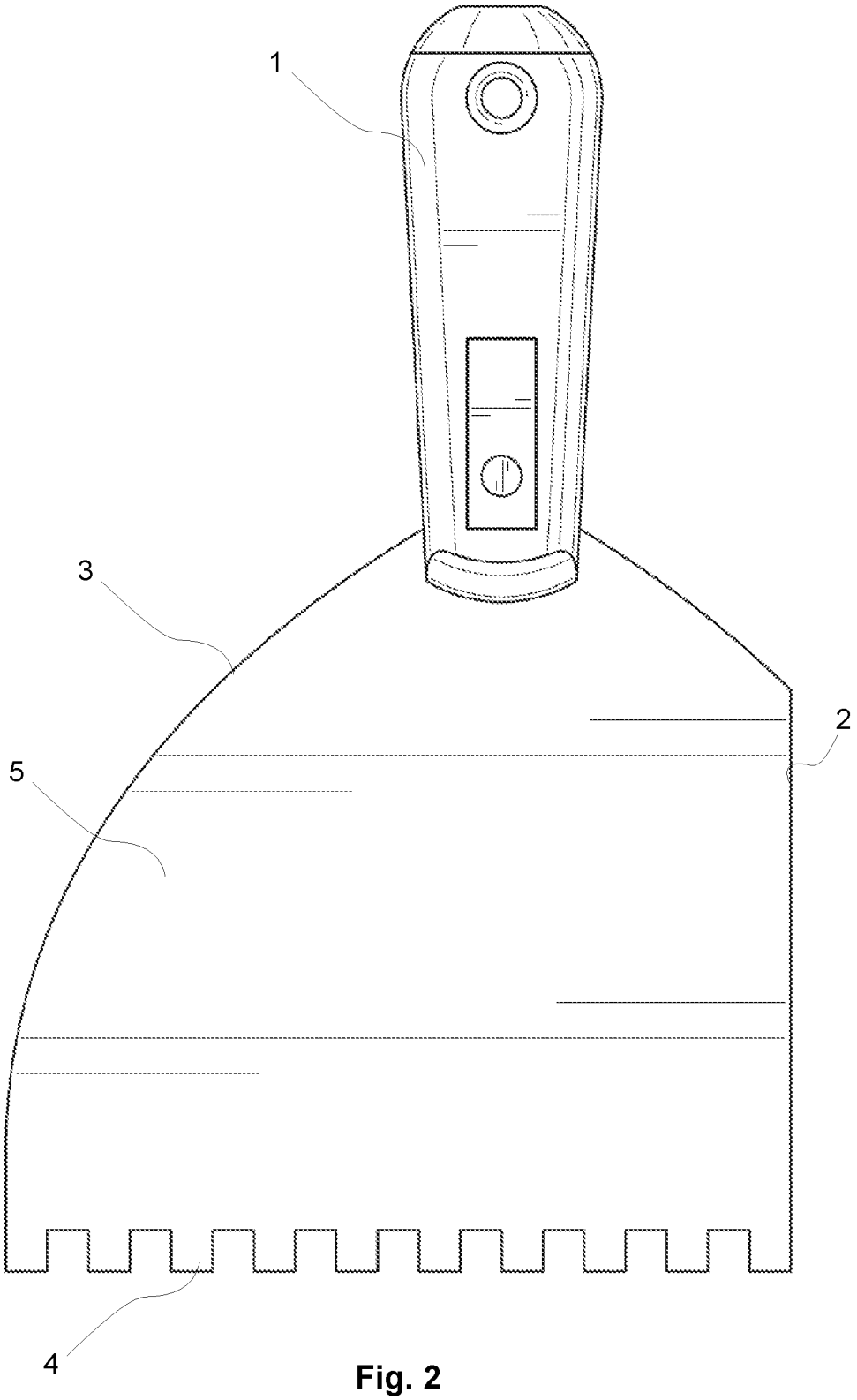
FIG. 2 is a front view thereof.

FIG. 2 is a front view of the trowel. Opposite straight side edge 2 is rounded side edge 3. Rounded side edge 3 offers a number of advantages over many existing trowels by allowing the blade 5 to be more compact, which allows users to use smaller buckets of adhesive that can be kept close to the worksite. Additionally, the rounded side edge 3 allows the user to alter the angle of the blade with respect to the work space, letting the notches reach areas that may be inaccessible to the standard rectangular trowel. This is especially so in light of the handle 1 disposed at the top of the blade, rather than on the back of the blade.

Opposite the handle 1 and between straight side edge 2 and rounded side edge 3 is the notched bottom edge 4. Notched bottom edge 4 being opposite handle 1 offers all of the versatility previously disclosed herein, as well as allowing a user to put the notches into quite tight spaces. It also allows the user to change the angle between the plane of the blade 5 and the surface being worked upon in a much more natural motion than with a standard trowel with a back-side handle. While some uses may require a more rigid blade 5, in preferred embodiments the blade may be made of a slightly flexible material, allowing a user to make a more consistent spread as the blade yields slightly to pressure applied by the user. Typically, blade 5 will be thinner than standard trowels; for example, blade 5 may be made of 22 gauge stainless steel. In some embodiments, blade 5 may be thicker or thinner, depending at least partly on the level of flexibility desired.

Figure 3:
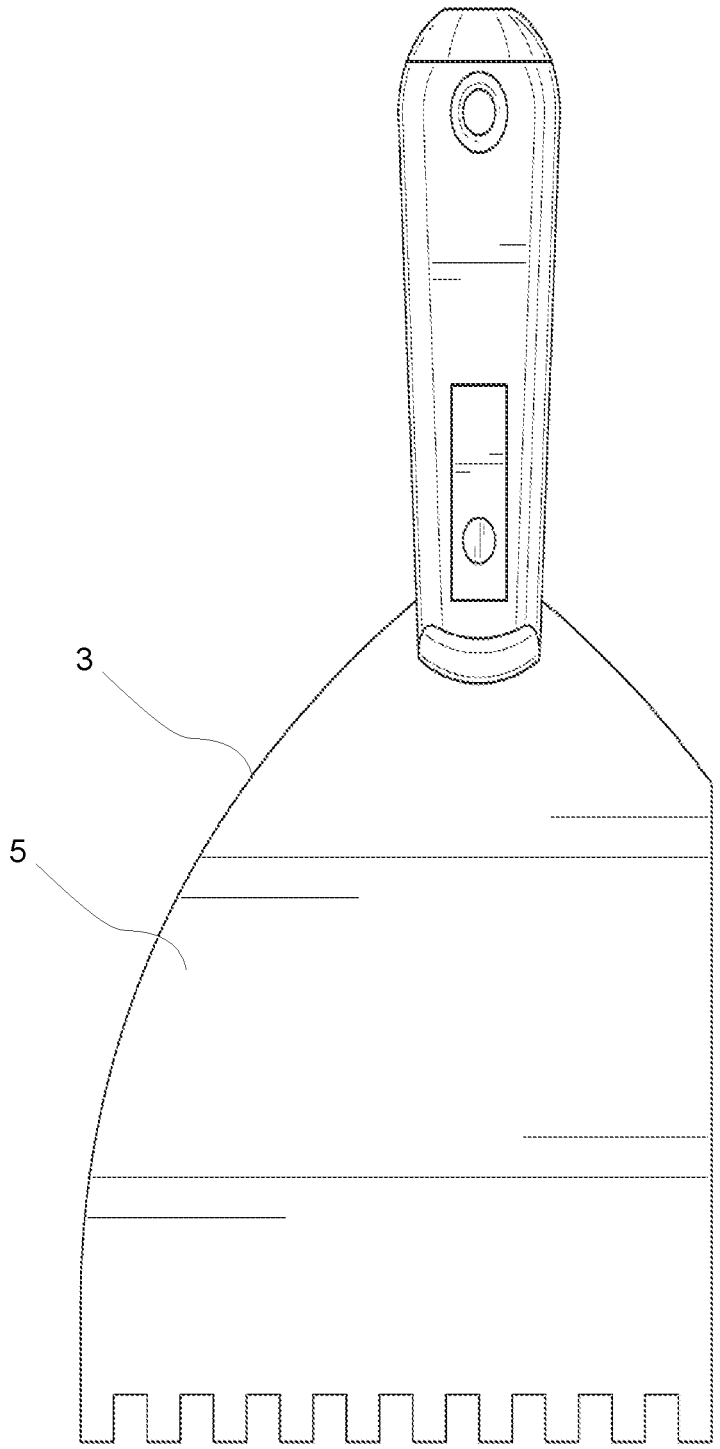
FIG. 3 is a front view of another embodiment of the trowel.
Figure 4:
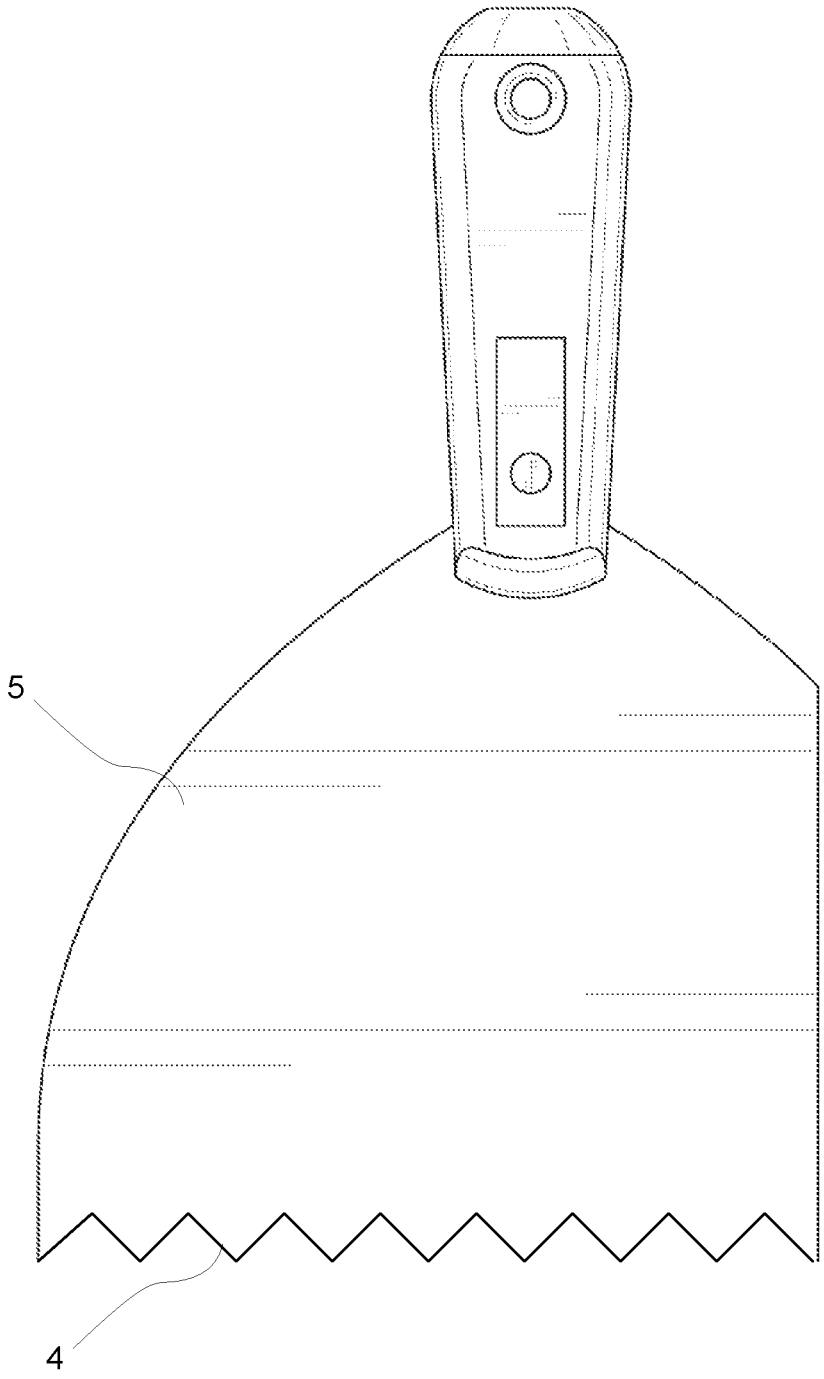
FIG. 4 is a front view of another embodiment of the trowel.

FIG. 3 is a depiction of a longer, narrower blade 5 having a larger radius on rounded side edge 3. Blades may be made longer or narrower to suit particular needs. As described elsewhere herein, a primary advantage of this invention is allowing a user to place the trowel in a variety of places, using the flexibility of the blade 5 and the rounded side 3 to change the angle and pressure of the blade for consistent results, even in hard to reach places. FIG. 4 is a depiction of a blade 5 having a notched edge 4 with v-notches, rather than square notches. It should be understood that while only the two most common notch types are depicted, square and v-notch, any notch shape desired by a user could be implemented with this design, including u-notches. Similarly, the particular size and spacing of notches will typically be set according to industry standards, but may be adjusted for particular uses.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A trowel comprising:

a blade having a rounded side edge, a straight side edge, and a square notched bottom edge, wherein the square notched bottom edge is between the rounded side edge and the straight side edge; and a handle disposed at a top of the blade opposite to the square notched bottom edge of the blade and substantially parallel to the straight side edge, wherein the handle and the blade are comprised of a single piece of material, wherein a coupling between the handle and the blade is disposed entirely between the rounded side edge and the straight side edge, and wherein a first edge and a second edge of the handle are closer to a longitudinal axis of the trowel than the rounded side edge and the straight side edge.

2. The trowel of claim 1, wherein the blade is substantially rigid.

3. The trowel of claim 1, wherein the blade is flexible.

4. The trowel of claim 1, wherein the longitudinal axis of the trowel extends from a center point on the square notched bottom edge of the blade to an end of the handle opposite the coupling between the handle and the blade.

5. The trowel of claim 1, wherein the trowel is comprised of a flexible material.

6. The trowel of claim 1, wherein the handle and the blade are comprised of a single piece of plastic.

7. The trowel of claim 1, wherein the square notched bottom edge includes exactly nine square notches.

* * * * *